US009198486B2

(12) United States Patent
Levinson et al.

(10) Patent No.: US 9,198,486 B2
(45) Date of Patent: Dec. 1, 2015

(54) LEFT AND RIGHT EARRING SUPPORT BACKINGS

(71) Applicants: Robin A. Levinson, Fort Lauderdale, FL (US); Ruben Derlly, Fort Lauderdale, FL (US)

(72) Inventors: Robin A. Levinson, Fort Lauderdale, FL (US); Ruben Derlly, Fort Lauderdale, FL (US)

(73) Assignee: EARRING SUPPORT, LLC, Fort Lauderdale, FL (US)

( * ) Notice: Subject to any disclaimer, the term of this patent is extended or adjusted under 35 U.S.C. 154(b) by 45 days.

(21) Appl. No.: 14/169,080

(22) Filed: Jan. 30, 2014

(65) Prior Publication Data

US 2015/0135490 A1 May 21, 2015

Related U.S. Application Data

(63) Continuation of application No. 29/473,110, filed on Nov. 19, 2013, now Pat. No. Des. 727,778.

(51) Int. Cl.
*A44C 7/00* (2006.01)

(52) U.S. Cl.
CPC ..... *A44C 7/003* (2013.01); *Y10T 24/41* (2015.01); *Y10T 24/45262* (2015.01)

(58) Field of Classification Search
None
See application file for complete search history.

(56) References Cited

U.S. PATENT DOCUMENTS

| | | | |
|---|---|---|---|
| 2,931,196 | A | 4/1960 | Liftman |
| 3,446,033 | A | 5/1969 | Driscoll |
| 3,563,056 | A | 2/1971 | Noel |
| 3,630,048 | A | 12/1971 | Masters |
| 4,688,400 | A | 8/1987 | Chioffe |
| 5,588,309 | A | 12/1996 | Chioffe |
| 5,906,114 | A | 5/1999 | Rissin |
| D461,140 | S | 8/2002 | Benhamou |
| 6,718,796 | B2 | 4/2004 | Baum et al. |
| 7,818,852 | B2 | 10/2010 | Van der Greft |
| 2002/0124364 | A1 | 9/2002 | Rissin et al. |
| 2007/0163298 | A1 | 7/2007 | Van der Greft |
| 2011/0191991 | A1 | 8/2011 | Meneau |

FOREIGN PATENT DOCUMENTS

| | | |
|---|---|---|
| JP | 3284204 | 3/1990 |
| JP | 03-295503 | 12/1991 |
| KR | 20-0391052 | 7/2005 |
| KR | 10-2010-00086450 | 1/2010 |
| KR | 10-0943245 | 2/2010 |

*Primary Examiner* — Jack W Lavinder
(74) *Attorney, Agent, or Firm* — The Concept Law Group, P.A.; Scott D. Smiley

(57) ABSTRACT

A pair of earring supports for use with earrings, the earring supports having an earring retainer with a center opening, the earring retainer has a first face and a second face with a fastening clip, each earring retainer has an earring support with a first end attached to the earring retainer and a second free end. One earring support extends in a counterclockwise direction from the earring retainer, and the other earring support extends in a clockwise direction from the earring retainer.

4 Claims, 6 Drawing Sheets

LEFT AND RIGHT EARRING SUPPORT BACKINGS

CROSS-REFERENCE TO RELATED APPLICATIONS

This application is a continuation application of co-pending U.S. patent application Ser. No. 29/473,110 filed Nov. 19, 2013, entitled Curlycue Earring Support, the disclosures of that patent application are incorporated herein, by reference, in their entireties.

FIELD OF THE INVENTION

The invention relates to earring support backings for use with earrings.

DESCRIPTION OF THE RELATED ART

Earring support backings for earrings are well known. However, earring support backings for earrings are not differentiated for placement on the left ear and the right ear.

SUMMARY OF THE INVENTION

The invention pertains to a pair of earring support backings for use with earrings, the earring support backings being distinguished from one another for placement on the left and right ears.

DESCRIPTION OF THE PREFERRED EMBODIMENTS

Figure 2:
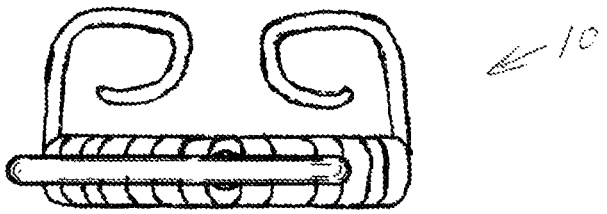
FIG. 2 is a top view of the left curlycue earring support.
Figure 1:
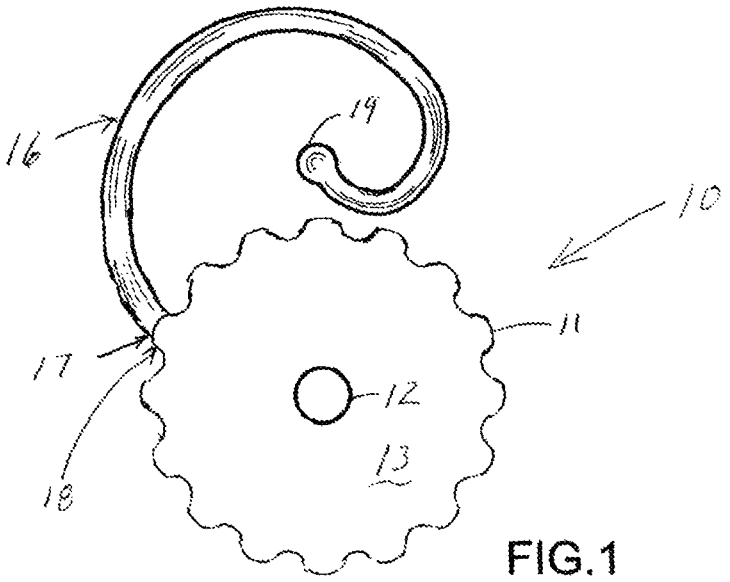
FIG. 1 is a front view of a left curlycue earring support.
Figure 3:
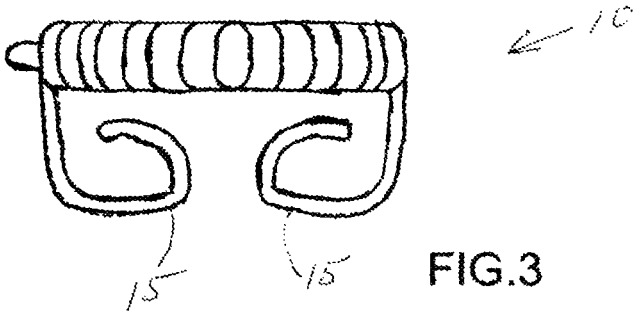
FIG. 3 is a bottom view of the left curlycue earring support.
Figure 5:
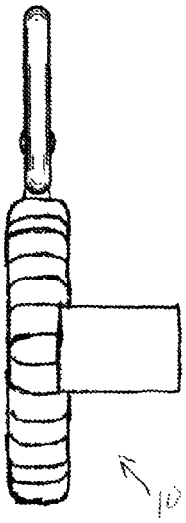
FIG. 5 is a right side view of the left curlycue earring support.
Figure 4:
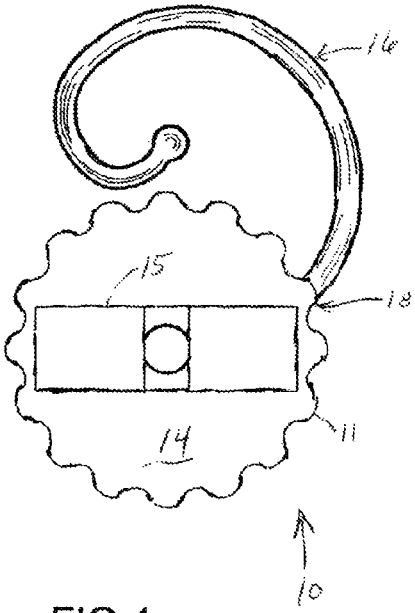
FIG. 4 is a rear view of the left curlycue earring support.
Figure 6:
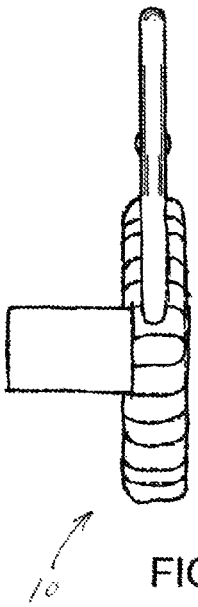
FIG. 6 is a left side view of the left curlycue earring support.
Figure 7:
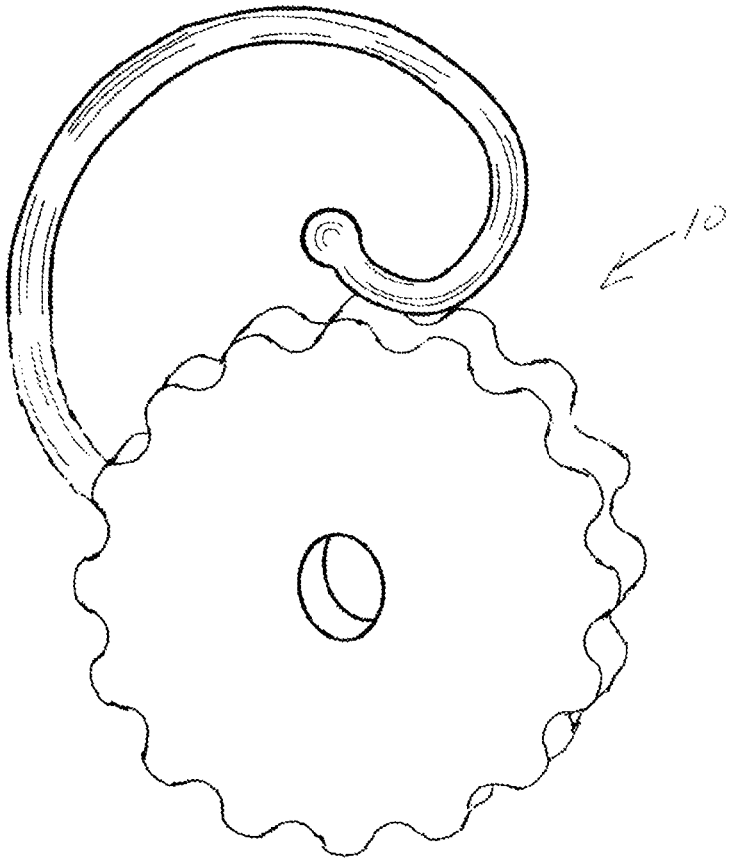
FIG. 7 is a front perspective view of the left curlycue earring support.

A pair of earring supports 10 and 30 includes a first earring support 10 shown in FIGS. 1 to 7, the first earring support 10 has an earring retainer 11 with a center opening 12. Retainer 11 has a first face 13 and a second face 14 opposite the first face 13. The second face 14 has a fastening clip 15, as known in the art, for fastening the first earring support 10 to an earring to be worn in a respective ear.

Earring retainer 11 has a stabilizer support 16 having a first end 17 at an attachment location 18 on the retainer 11. The stabilizer support 16 extends from retainer 11 to a free end 19 of the stabilizer support 16 spaced apart from the retainer 11. The free end 19 being counterclockwise from the attachment location 18 when viewing the retainer 11 in a direction from the second face 14 of the retainer 11.

Figure 9:
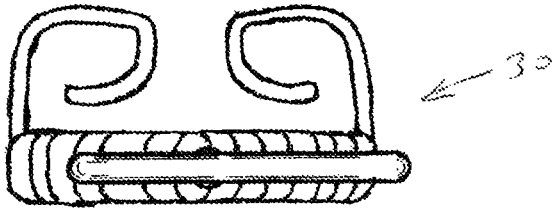
FIG. 9 is a top view of the right curlycue earring support.
Figure 8:
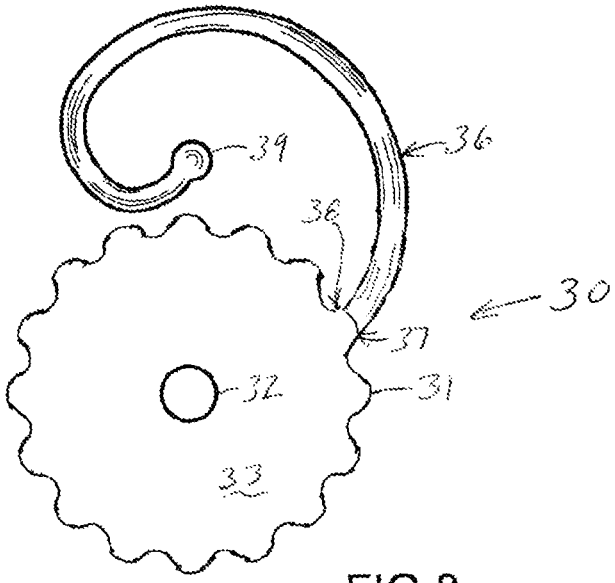
FIG. 8 is a front view of a right curlycue earring support.
Figure 10:
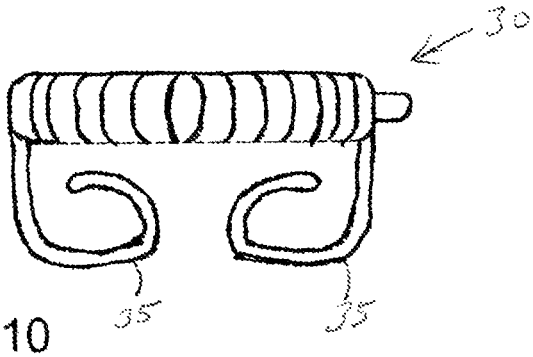
FIG. 10 is a bottom view of the right curlycue earring support.
Figure 12:
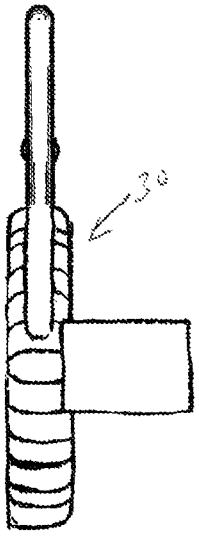
FIG. 12 is a right side view of the right curlycue earring support.
Figure 11:
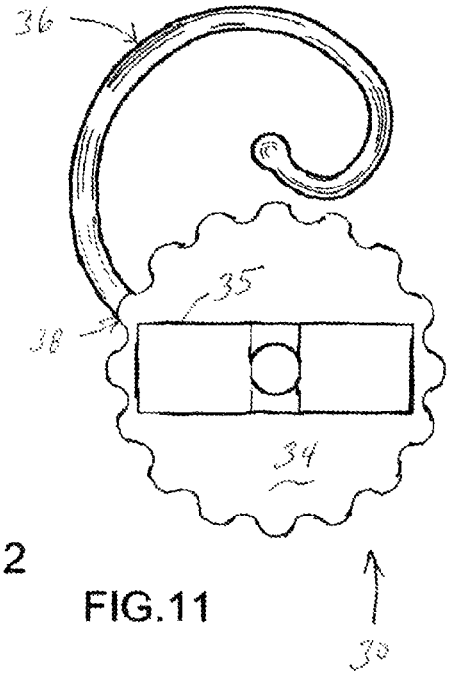
FIG. 11 is a rear view of the right curlycue earring support.
Figure 13:
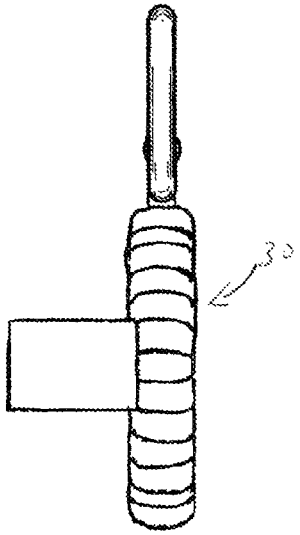
FIG. 13 is a left side view of the right curlycue earring support.
Figure 14:
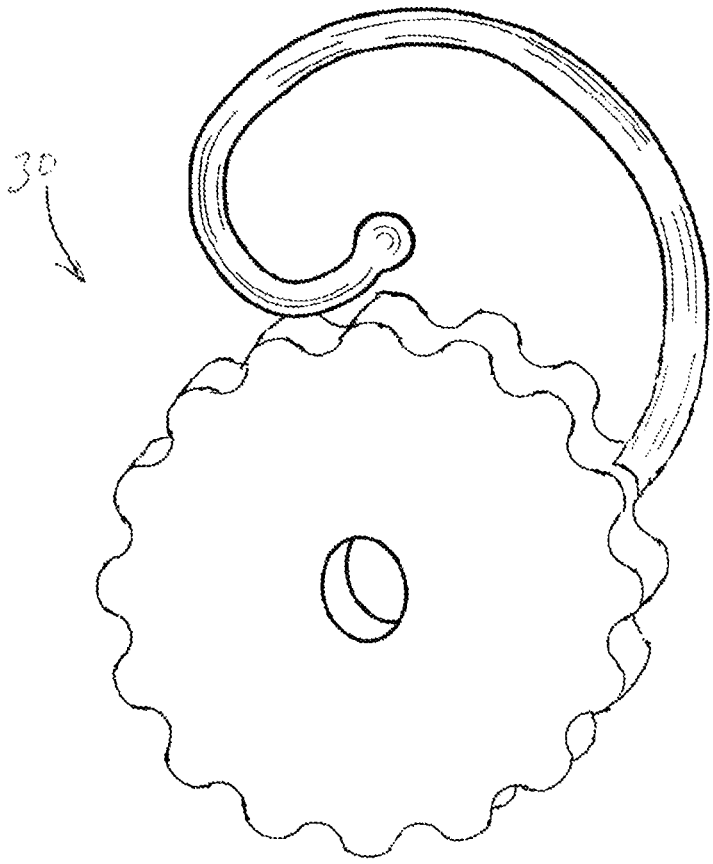
FIG. 14 is a front perspective view of the right curlycue earring support.

The pair of earring supports 10 and 30 includes a second earring support 30 shown in FIGS. 8 to 14, the second earring support 30 has a second earring retainer 31 with a center opening 32. Retainer 31 has a first face 33 and a second face 34 opposite the first face 33. The second face 34 has a fastening clip 35, as known in the art, for fastening the second earring support 30 to an earring to be worn in a respective ear.

Earring retainer 31 has a stabilizer support 36 having first end 37 at an attachment location 38 on retainer 31. The stabilizer support 36 extends from retainer 31 to a free end 39 of the stabilizer support 36 spaced apart from the second retainer 31. The free end 39 being clockwise from the attachment location 38 when viewing the retainer 31 in a direction from the second face 34 of the retainer 31.

While the invention has been describe in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A pair of earring supports for a pair of earrings having earring posts, the pair of earring supports comprising:

retainer plates each retainer plate respectfully having:

a post hole formed therein;

a first face configured for engaging an ear;

a second face opposite said first face, said second face having a fastening clip configured for engaging an earring post passing through said post hole; and a stabilizing support, for each retainer plate, respectively, having an attachment end affixed at an attachment location on said retainer plate, said stabilizing support extending in a spiral from said retainer plate to a free end of said stabilizing support spaced apart from said retainer plate;

said free end of a first stabilizing support being counterclockwise from said first attachment location of said first retainer plate when viewing said first retainer plate in a direction from said second face of said first retainer plate; and said free end of a second stabilizing support being clockwise from said attachment location of said second retainer plate when viewing said second retainer plate in a direction from said second face of said second retainer plate.

2. The earring support as in claim 1 wherein said stabilizer support defines a cantilever between the attachment point and the free end.

3. An earring support for an earring having an earring post, the earring support comprising:

a retainer plate having a post hole formed therein, a first face configured for engaging an ear, a second face opposite said first face;

said second face having a fastening clip configured for engaging an earring post passing through said post hole;

said retainer plate having a stabilizing support, said stabilizing support having an end affixed at an attachment location on said retainer plate, said stabilizing support extending in a spiral from said retainer plate to a free end of said stabilizing support spaced apart from said retainer plate.

4. The earring support as in claim 3 wherein, said free end being at a position which is one of clockwise or counterclockwise from said attachment location when viewing said retainer plate in a direction from said second face of said retainer plate.

* * * * *